US005447188A

United States Patent [19]

Srostlik et al.

[11] Patent Number: 5,447,188

[45] Date of Patent: Sep. 5, 1995

[54] PROCESS OF AND APPARATUS FOR CASTING METALS WITHOUT SPRUES

[75] Inventors: Peter Srostlik, Maintal; Alfred Walter, Hanau, both of Germany

[73] Assignee: Bachmann Giesserei und Formenbau GmbH & Co. KG, Frankfurt am Main, Germany

[21] Appl. No.: 119,114

[22] PCT Filed: Mar. 12, 1992

[86] PCT No.: PCT/EP92/00547

§ 371 Date: Sep. 17, 1993

§ 102(e) Date: Sep. 17, 1993

[87] PCT Pub. No.: WO92/17296

PCT Pub. Date: Oct. 15, 1992

[30] Foreign Application Priority Data

Mar. 26, 1991 [DE] Germany ..... 41 09 793.9

[51] Int. Cl.[6] ..... B22D 17/12; B22D 18/02

[52] U.S. Cl. ..... 164/120; 164/113; 164/133; 164/319

[58] Field of Search ..... 164/113, 120, 133, 284, 164/304, 319

[56] References Cited

U.S. PATENT DOCUMENTS

| | | | |
|---|---|---|---|
| 969,539 | 9/1910 | Kitchen | 164/120 X |
| 4,991,641 | 2/1991 | Kidd et al. | 164/113 X |
| 5,109,914 | 5/1992 | Kidd et al. | 164/113 |

FOREIGN PATENT DOCUMENTS

| | | | |
|---|---|---|---|
| 597704 | 5/1934 | Germany . | |
| 2855200 | 6/1980 | Germany . | |
| 3528691 | 2/1987 | Germany . | |
| 55-106668 | 8/1980 | Japan | 164/120 |
| 58-125358 | 7/1983 | Japan | 164/120 |
| 63-194864 | 8/1988 | Japan | 164/133 |

*Primary Examiner*—J. Reed Batten, Jr.
*Attorney, Agent, or Firm*—Wenderoth, Lind & Ponack

[57] ABSTRACT

Liquid metal is supplied from the bottom to the top into a casting mold by way of a casting runner and a filling hole arranged at the lowest point of a casting mold. Direct further use of the casting by avoiding formation of a sprue that must be subsequently processed is possible due to the fact that after totally filling the casting mold and only partial solidification of the metal therein, the casting pressure is decreased or turned off, so that liquid metal flows back out of the casting mold only through a return flow channel having a cross section significantly smaller than the cross section of the casting runner. A ram having a face corresponding in size and shape to the outer contour of the casting in the region of the filling hole is pushed at least over the last segment of the casting runner, thus displacing liquid metal present in the last segment into the casting mold sufficiently far in the direction of the mold interior until the fact of the ram aligns with the inner contour of the casting mold.

21 Claims, 1 Drawing Sheet

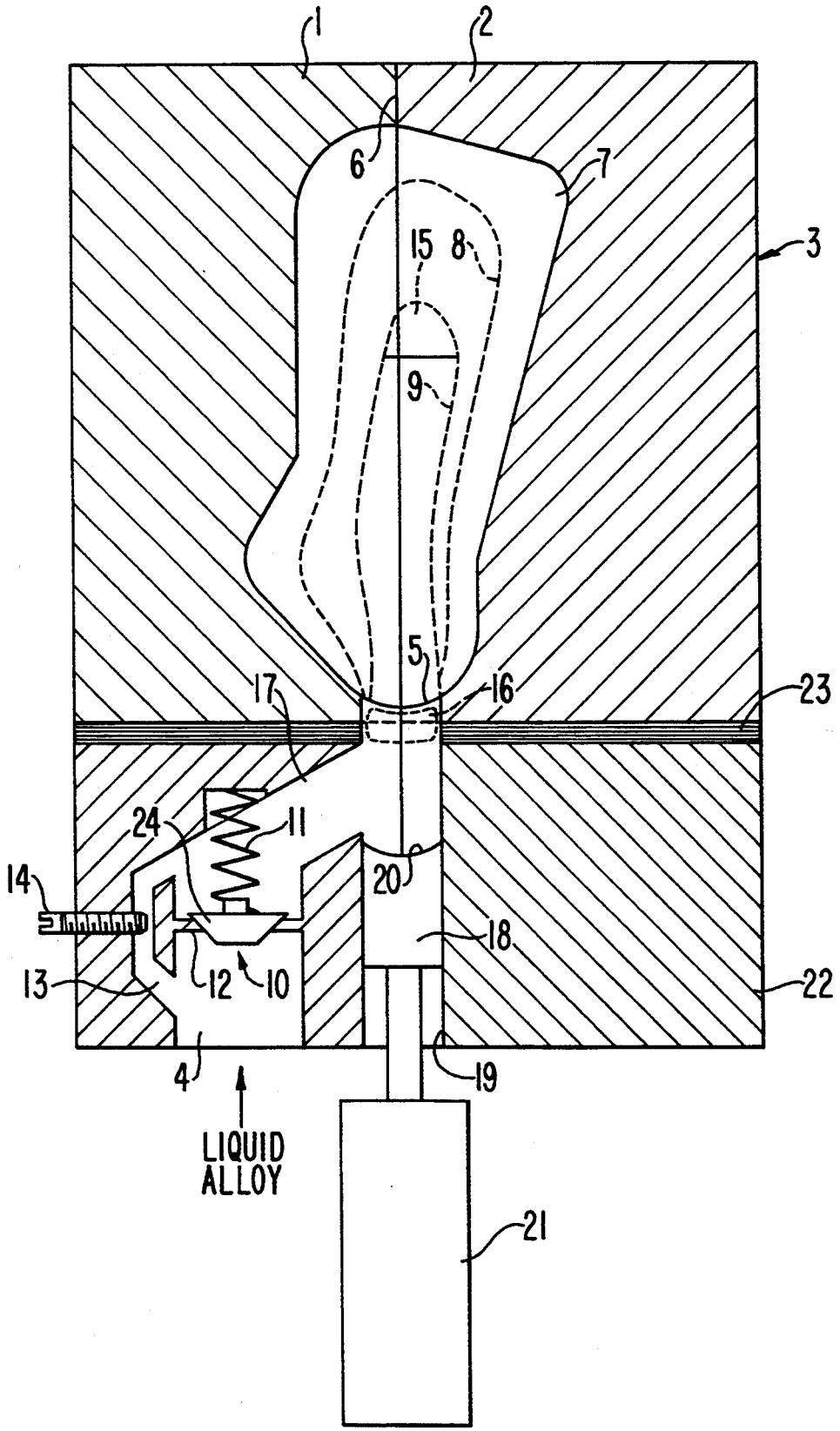
1
2
6
7
3
15
8
9
5
17
16
23
24
11
14
20
18
13
12
10
22
4
19
LIQUID
ALLOY
21

PROCESS OF AND APPARATUS FOR CASTING METALS WITHOUT SPRUES

BACKGROUND OF THE INVENTION

The invention relates to a process for casting metals, in particular alloys with low melting points, during which process liquid metal is filled from the bottom to the top into a casting mold by way of a casting runner and a filling hole arranged at the lowest point of the casting mold, and to an apparatus to effect such a process.

Such processes are employed, for example, during the production of lost cores for injection molded plastic parts. During such process top casting must be avoided, so that the casting takes place by necessity at the lowest point of the mold. To date the liquid metal during the process of the aforementioned kind has been filled under pressure into the casting mold and the casting pressure has been maintained until the metal has totally solidified in the casting mold. After the metal has solidified, the resulting sprue or runner has to be removed and the filling point has to be ground smooth.

The cores produced in this manner are used, among other things, for mass producing plastic parts in the automobile industry, where it is important on account of high quantity requirements to hold the cost of production as low as possible. However, these costs are significantly increased by the requisite subsequent treatment and the additionally required machines or manual activity.

SUMMARY OF THE INVENTION

Therefore, the object of the invention is to develop a process and apparatus by which a casting can be produced without sprues or runners and can be directly further used without subsequent processing.

This object is achieved according to the invention by decreasing or turning off the casting pressure after totally filling the casting mold and only partial solidification of the metal in the casting mold, so that the liquid metal flows back out of the casting mold by way of a return flow channel having a cross section significantly smaller than the cross section of the casting runner. A ram having a face corresponding in size and shape to the outer contour of the casting in the region of the filling hole is pushed at least over the last segment of the casting runner, thus displacing the liquid metal present therein into the casting mold as far in the direction of the mold interior until the fact of the ram aligns with the inner contour of the casting mold. Due to the adaptation of the fact of the ram to the desired outer contour of the core in the region of the filling hole, the core is located now in a totally closed casting mold and solidifies without forming a casting sprue that must be subsequently processed.

When advancing the ram and closing the filling hole at the end of the casting operation, the ram displaces the liquid material, a process that would not have been possible with the conventional process since the mold with the liquid metal is filled totally without air pockets. However, a cavity, into which the ram can be subsequently pushed upon closing the filling hole of the liquid metal, is created according to the invention in the casting mold by means of the return flow of the liquid metal out of the casting mold after reducing or switching off the casting pressure. The return flow volume is controlled by the cross section of the return flow channel being significantly smaller than the cross section of the casting runner. In this manner it is ensured that until the filling hole is closed by the ram, not too much liquid metal has flowed back and the cavity within the casting mold is not too large.

Upon pressing the metal into the casting mold, the ram closes according to the invention the casting runner before the face of the ram aligns with the inner contour of the casting mold. In this manner it is achieved that the metal displaced by the ram is forced reliably into the casting mold and is not discharged partially by way of the casting runner, thus preventing a defined filling of the cavity in the casting mold.

To achieve maximum filling of the cavity produced in the casting mold by means of the return flow of the metal, it is provided in another embodiment of the inventive idea that the volume of the metal that has flowed back from the casting mold is greater than or equal to the volume $V_s$ of the metal displaced by the ram into the interior of the casting mold. A residual cavity, which always remains eventually in the region of the still liquid metal in the interior of the casting mold, it maintained very small by means of the process according to the invention and does not limit the use of the casting in any way.

Defined conditions for the liquid metal flowing back and the closing of the filling hole are achieved expediently by moving the ram by means of random time control. In so doing, the period of time to fill the casting mold by way of the casting runner with metal amounts to approximately 20 seconds, the period of time from the end of filling the casting mold with metal until reducing or switching off the casting pressure amounts to approximately 40 seconds, and the entire period from the start of the casting operation until the closing of the filling hole by means of the ram amounts to approximately 80 seconds. It has turned out that upon observing these recommended times, the cavity remaining in the casting mold can be held very small or in the ideal case can be even totally avoided.

The invention also relates to an apparatus to carry out the above process. Such device includes a nonreturn valve, opening in the direction of casting, disposed in the casting runner outside the segment over which the ram passes. A return flow channel, acting as a bypass channel for the nonreturn valve in the casting runner and bridging the nonreturn valve, has a cross section that is significantly smaller than the cross section of the casting runner. By means of the nonreturn valve, the liquid metal is prevented from flowing back through the casting runner after the casting pressure has been switched off, so that only a relatively small quantity of liquid metal can flow back through the return flow channel bypassing the non-return valve. To achieve a slow, defined return flow of the melt, it has proven to be expedient that the ratio of the cross section of the return flow channel to the cross section of the casting runner ranges in an order of magnitude of 1:10 to 1:50. Preferably this cross section of the return flow channel can be modified, e.g., by means of a setscrew, in order to be adapted optionally to different conditions when casting different alloys.

The solution according to the invention is characterized by the fact that the casting runner includes a segment which opens into the filling hole and, when seen in the direction of filling, is last, and which extends coaxially to the ram and its direction of displacement. Further, the last segment of the casting runner has an entry segment, which is inclined laterally and in which is disposed the nonreturn valve.

The ram is guided preferably in a bore of the casting mold which extends coaxially to the last segment of the casting runner, so that the ram is conveyed exactly to the filling hole of the casting mold. Since the face of the ram is adapted to the desired outer contour of the casting, which may or may not be rotationally symmetrical, the ram preferably is guided in the bore to not be twistable or rotatable therein. The forces required to displace the liquid metal are generated according to the invention by the fact that the ram can be driven hydraulically.

In a preferred embodiment it is ensured that the casting runner is closed after the casting pressure has been switched off by the fact that the nonreturn valve is pressed by a pull back spring against a valve seat.

The metal has to be kept liquid in the casting runner in order not to obstruct the ram while closing the filling hole. Therefore, the temperature in the casting runner has to be greater than or equal to the melting temperature of the alloy to be cast, while the temperature of the casting mold, in which the casting is supposed to solidify, has to be less. Therefore, in another embodiment of the invention it is provided that a significant proportion of the casting runner and the ram are arranged in a housing which is connected detachably to the casting mold with a thermal barrier therebetween. In this manner, the loss of temperature from the housing to the casting mold is reduced.

BRIEF DESCRIPTION OF THE DRAWING

Improvements, advantages and possible applications of the invention will be apparent from the following description of one embodiment and the accompanying drawing. At the same time, all of the described and/or illustrated features form by themselves or in any arbitrary logical combination the subject matter of the invention, independently of their summary in the claims or their references.

The sole FIGURE is a diagrammatic drawing of a casting apparatus according to the invention.

DETAILED DESCRIPTION OF THE INVENTION

Liquid metal, in particular an alloy with a low melting point, is filled from the bottom to the top into a cavity within a casting mold 3, comprising two mold halves 1, 2, by way of a casting runner 4 and a filling hole 5, arranged at the lowest point of the casting mold 3. The liquid metal is forced under pressure into the casting mold 3, during which process the air contained in the casting mold 3 escapes through a gap 6 existing between the mold halves 1, 2. The gap 6 is too small for the liquid metal also to flow therethrough. In this manner it is ensured that no unwanted deposit forms on the joint face of the casting mold 3.

After totally filling the casting mold 3, the metal contained in the casting mold 3 begins to solidify to form a casting 7, and in particular starting at the outer edges of the casting 7 and progressing toward the interior. In so doing, lines 8, 9 in the drawing denote lines of identical solidification. After a predetermined period of time, in particular when only a relatively small volume of metal in the interior of the mold is still liquid, the casting pressure is switched off. Upon switching off the casting pressure, the liquid metal flows, subject to the action of gravity, out of the casting mold 3. However, the liquid metal is prevented from flowing back through the casting channel due to the fact that the casting runner 4 has a nonreturn valve 10, which opens in the direction of casting and having a valve body 24 that is forced against a valve seat 12 by a pull back spring 11 and thus closes the casting runner 4 upon lack of casting pressure. Therefore, the liquid metal can flow back only through a return flow channel 13 which bypasses the nonreturn valve 10 and acts as a bypass channel and whose cross section is significantly less than the cross section of the casting runner 4. Preferably the ratio between the cross section of the return flow channel 13 and the cross section of the casting runner 4 is on the order of magnitude of 1:10 to 1:50. The cross section of the return flow channel 13 can be modified, e.g., by way of a setscrew 14 in order to be able to adapt, if desired, to different alloys and casting volumes.

The casting runner 4 is subdivided into a last segment 16 opening into the filling hole 5 and an entry segment 17, which is inclined laterally and in which the nonreturn valve 10 is arranged. A ram 18, which is guided in a bore 19 of the casting mold 13, can be displaced coaxially to the last segment 16 of the casting runner 4, bore 19 extending coaxially to the last segment 16 of the casting runner 4. A face 20 of the ram 18 corresponds in size and shape to the contour of the of the casting 7 in the region of the filling hole 5. Since this contour of the casting 7 is usually not rotationally symmetrical, the ram 18 is guided in the bore 19 to not be twistable or rotatable therein.

Upon switching off the casting pressure, one portion of the liquid metal flows back out of the casting mold 3 into the casting runner 4, thus producing a cavity 15 in the casting 7. The metal flows back very slowly through the small cross section of the return flow channel 13, so that the size of the resulting cavity 15 can be accurately defined through time control. The liquid metal present in the last segment 16 of the casting runner 4 is forced back into the casting mold 3 by means of the ram 18 when ram 18 is advanced. Through time control the volume of metal that has flowed back and thus the volume of the resulting cavity 15 can be tuned accurately to that of the metal forced back into the casting mold 3 by means of the ram 18, so that the cavity 15 is totally refilled or at least almost totally refilled.

The fact 20 of the ram 18 corresponds in size and shape to the outer contour of the casting 7 in the region of the filling hole 5. Thus, the inner contour of the totally closed casting mold 3 upon closing the filling hole 5 by means of the ram 18 corresponds exactly to the desired outer contour of the casting 7. Therefore, no casting runner or sprue is formed, so that the casting 7 upon removal from the casting mold 3 can be further used without subsequent processing.

The ram 18 is driven by means of a hydraulic drive 21. A significant portion of the casting runner 4 and the ram 18 is arranged in a housing 22, which is connected detachably to the casting mold 3 with a thermal barrier 23 therebetween.

We claim:

1. A process for casting molten metal to form a metal casting, said process comprising:

filling molten metal under a casting pressure into a cavity of a casting mold through a casting runner and a filling hole located in a lowest position of said cavity of said casting mold;

after said cavity is totally filled with molten metal and after only partial solidification of said metal in said cavity, decreasing or stopping said casting pressure, whereby molten metal not yet solidified within said cavity flows outwardly therefrom through a return flow channel having a cross section significantly smaller than the cross section of said casting runner; and displacing molten metal thus withdrawn from said cavity and present in a last segment of said casting runner adjacent said cavity by pushing said withdrawn molten metal from said last segment back into said cavity with a ram having a face corresponding in size and shape to an outer contour of said metal casting to be formed in the region of said filling hole until said face of said ram aligns with an inner contour of said cavity of said casting mold.

2. A process as claimed in claim 1, wherein said pushing causes said ram to close said casting runner before said face of said ram aligns with said inner contour of said cavity of said casting mold.

3. A process as claimed in claim 1, wherein said molten metal flowed from said cavity has a volume greater than or equal to a volume of said molten metal displaced back into said cavity by being pushed by said ram.

4. A process as claimed in claim 1, comprising controlling movement of said ram by a selectable time control.

5. A process as claimed in claim 1, comprising conducting said filling such that a period of time to fill said cavity is approximately 20 seconds.

6. A process as claimed in claim 1, comprising conducting said decreasing or stopping of said casting pressure approximately 40 seconds after completion of said filling.

7. A process as claimed in claim 1, wherein said entire process, from the start of said filling until closing of said filling hole by said ram, comprises approximately 80 seconds.

8. A process as claimed in claim 1, comprising regulating said cross section of said return flow channel.

9. An apparatus for casting molten metal to form a metal casting, said apparatus comprising:

a casting mold having a cavity of a configuration of a metal casting to be formed;

a casting runner leading to a filling hole opening into said cavity at a lowest position thereof, thereby to enable molten metal to be filled into said cavity under a casting pressure;

a return flow channel bypassing at least a portion of said casting runner and having a cross section significantly smaller than the cross section of said casting runner, whereby, after said cavity is totally filled with molten metal and after only partial solidification of the metal in said cavity, the casting pressure may be decreased or stopped, whereupon molten metal not yet solidified within said cavity flows outwardly therefrom through said return flow channel;

a ram having a face corresponding in size and shape to an outer contour of the metal casting to be formed in the region of said filling hole; and means for moving said ram from a position withdrawn from said cavity toward said cavity, such that said ram displaces molten metal that had been withdrawn from said cavity and that is present in a last segment of said casting runner adjacent said cavity back into said cavity, until said face of said ram aligns with an inner contour of said cavity of said casting mold.

10. An apparatus as claimed in claim 9, further comprising a nonreturn valve positioned in said casting runner and operable to allow molten metal to be supplied under the casting pressure through said casting runner in a direction toward said cavity and to prevent flow of molten in an opposite direction through said casting runner, said return flow channel bypassing said nonreturn valve.

11. An apparatus as claimed in claim 10, wherein said nonreturn valve comprises a valve seat, a valve body movable toward and away from said valve seat, and means to urge said valve body toward said valve seat.

12. An apparatus as claimed in claim 9, wherein a ratio of said cross section of said return flow channel to said cross section of said casting runner is from 1:10 to 1:50.

13. An apparatus as claimed in claim 9, further comprising means for adjusting said cross section of said return flow channel.

14. An apparatus as claimed in claim 13, wherein said adjusting means comprises a setscrew.

15. An apparatus as claimed in claim 9, wherein said last segment of said casting runner extends coaxially of said ram.

16. An apparatus as claimed in claim 15, wherein said casting runner further includes an entry segment leading to said last segment and extending in a direction inclined relative thereto.

17. An apparatus as claimed in claim 16, further comprising a nonreturn valve positioned in said entry segment.

18. An apparatus as claimed in claim 15, wherein said ram is guided for movement in a bore in said casting mold, said bore extending coaxially of said last segment.

19. An apparatus as claimed in claim 18, wherein said ram is positioned non-rotatably in said bore.

20. An apparatus as claimed in claim 9, wherein said moving means comprises a hydraulic drive.

21. An apparatus as claimed in claim 9, wherein a significant portion of said casting runner and said ram are within a housing detachably mounted on said casting mold with a thermal barrier positioned therebetween.

* * * * *